US011717470B2

(12) United States Patent
Fox et al.

(10) Patent No.: US 11,717,470 B2
(45) Date of Patent: Aug. 8, 2023

(54) FLIP-TOP DISPENSING CLOSURE

(71) Applicant: Obrist Closures Switzerland GmbH, Reinach (CH)

(72) Inventors: Jamie David Fox, Norwich (GB); Stephen Alexander Faragher, Norwich (GB)

(73) Assignee: Obrist Closures Switzerland GmbH, Reinach (CH)

( * ) Notice: Subject to any disclaimer, the term of this patent is extended or adjusted under 35 U.S.C. 154(b) by 545 days.

(21) Appl. No.: 15/745,533

(22) PCT Filed: Jul. 18, 2016

(86) PCT No.: PCT/EP2016/067087
§ 371 (c)(1),
(2) Date: Jan. 17, 2018

(87) PCT Pub. No.: WO2017/013081
PCT Pub. Date: Jan. 26, 2017

(65) Prior Publication Data

US 2018/0207061 A1 Jul. 26, 2018

(30) Foreign Application Priority Data

Jul. 17, 2015 (GB) ..... 1512640

(51) Int. Cl.
*A61J 1/14* (2023.01)
*B65D 47/08* (2006.01)
(Continued)

(52) U.S. Cl.
CPC ..... *A61J 1/1406* (2013.01); *A61J 1/1425* (2015.05); *A61J 1/1487* (2015.05);
(Continued)

(58) Field of Classification Search
CPC ..... A61J 1/1406; A61J 1/2037; A61J 1/14; B65D 47/08; B65D 47/2031; B65D 23/12; A61M 37/00
(Continued)

(56) References Cited

U.S. PATENT DOCUMENTS 5,092,840 A * 3/1992 Healy ..... A61J 1/2096 604/167.03
5,251,873 A * 10/1993 Atkinson ..... A61M 39/045 251/149.1
(Continued)

OTHER PUBLICATIONS

Sep. 29, 2016—(WO) International Search Report and Written Opinion—App PCT/EP2016/067087.

*Primary Examiner* — Anthony D Stashick
*Assistant Examiner* — Raven Collins
(74) *Attorney, Agent, or Firm* — Banner & Witcoff, Ltd.

(57) ABSTRACT

A flip-top dispensing closure is provided and comprises a base which is attachable to a container and a lid attached to the base by a hinge. The base includes a dispensing passage; a syringe of the type comprising a barrel and a terminal tip is insertable into the passage. The closure further comprises a flexible self-closing valve for closing the passage. In use the syringe is inserted into the passage so that the tip passes through the valve to access product, and thereafter when the syringe is withdrawn the valve wipes against the syringe tip.

13 Claims, 10 Drawing Sheets

Figure 1:
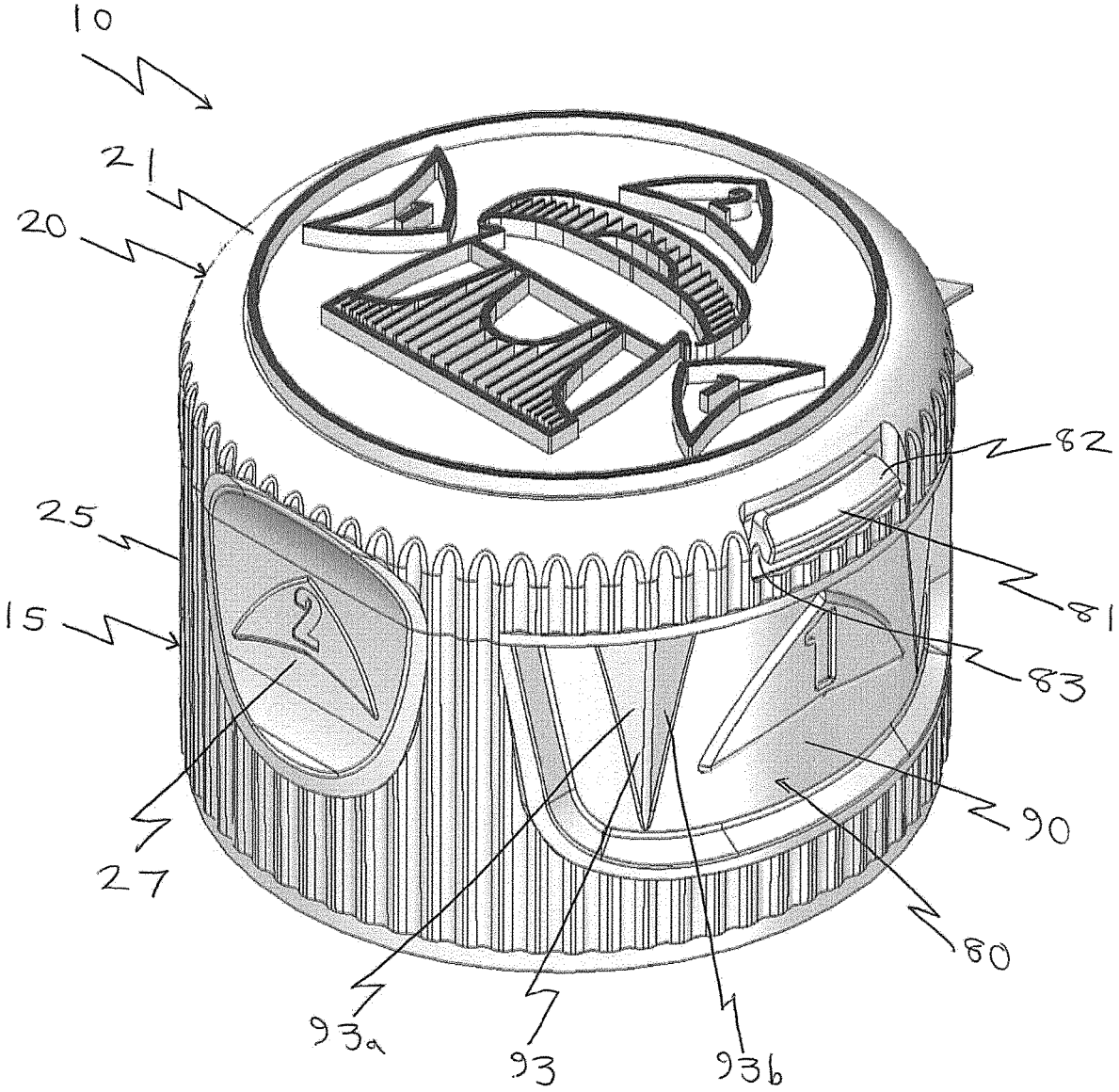

(51) Int. Cl.
*B65D 47/20* (2006.01)
*A61J 7/00* (2006.01)
*B65D 50/04* (2006.01)

(52) U.S. Cl.
CPC ..... *B65D 47/0804* (2013.01); *B65D 47/2031* (2013.01); *B65D 50/046* (2013.01); *A61J 7/0053* (2013.01)

(58) Field of Classification Search
USPC ..... 215/247; 604/83
See application file for complete search history.

(56) References Cited

U.S. PATENT DOCUMENTS

| | | | | |
|---|---|---|---|---|
| 5,484,070 | A * | 1/1996 | Graham | A61J 7/0046 215/217 |
| 7,056,308 | B2 * | 6/2006 | Utterberg | A61M 39/02 604/256 |
| 8,540,677 | B2 * | 9/2013 | McKinnon | A61M 39/26 604/167.04 |
| 9,604,740 | B2 * | 3/2017 | Py | A61J 3/002 |
| 2008/0142468 | A1 * | 6/2008 | Delagrange | B65D 50/046 215/209 |
| 2010/0327010 | A1 * | 12/2010 | Manera | A61J 1/2096 141/357 |
| 2013/0270273 | A1 | 10/2013 | Fox et al. | |
| 2016/0167844 | A1 * | 6/2016 | Wu | B65D 43/162 215/209 |

* cited by examiner

FLIP-TOP DISPENSING CLOSURE

CROSS-REFERENCE TO RELATED APPLICATIONS

The present application is a U.S. National Phase of International Application No. PCT/EP2016/067087, filed on Jul. 18, 2016, designating the United States of America, and claims priority to British Patent Application No. 1512640.2, filed Jul. 17, 2015. This application claims priority to and the benefit of the above-identified applications, each of which is fully incorporated by reference herein.

The present invention relates generally to closures and particularly to a dispensing closure for use with a syringe or the like dispenser.

In one aspect the present invention provides a flip-top closure, for example a child-resistant closure, for use with a syringe or the like (for example a tube with a nozzle and piston or bulb for sucking in and ejecting flowable product in a thin stream).

In some aspects and embodiments the present invention involves the use of a membrane (for example a self-closing valve) and a child-resistant flip-top closure in conjunction with a syringe to provide advantages not currently seen with syringe packs.

Concepts forming part of the present invention are:

1) dispensing closure with a valve, and a syringe
2) child-resistant closure with a valve, and a syringe
3) child-resistant flip-top closure+membrane for use with syringe
4) child-resistant flip-top closure for use with syringe (without membrane)
5) child-resistant closure for use with a syringe The closure may be a flip-top closure, with a base and a lid joined by a hinge.

The closure may include a base which is attachable (for example by screw thread engagement or snap-fit/snap-on engagement). The closure may be non-removable.

An aspect of the present invention provides a flip-top dispensing closure comprising a base which is attachable to a container and a lid attached to the base by a hinge, the base includes a dispensing passage, a syringe of the type comprising a barrel and a terminal tip is insertable into the passage, the closure further comprises a flexible self-closing valve for closing the orifice, in use the syringe is inserted into the passage so that the tip passes through the valve to access product, and thereafter when the syringe is withdrawn the valve wipes against the syringe tip.

A further aspect provides a flip-top dispensing closure comprising a base which is attachable to a container and a lid attached to the base by a hinge, the base includes a dispensing passage, a syringe of the type comprising a barrel and a terminal tip is insertable into the passage, the closure further comprises a flexible self-closing valve for closing the orifice.

The base may include a top plate. The top plate may comprise a central dome section in which the passage is provided.

The valve may be carried on or by a valve retainer which is receivable in the passage.

Child-resistant means may be provided for preventing opening of the lid.

The dispensing passage may include an internal bead for gripping the syringe barrel in use.

The present invention also provides a dispensing pack comprising a closure as described herein in combination with a dispensing syringe.

The membrane/valve may function to wipe or clean the syringe, for example the exterior of the tip.

The use of a valve membrane can give the ability to remove the syringe from the pack whilst it is still inverted without spilling product.

The closure may be provided with a socket for receiving a syringe.

The present invention may provide a closure in combination with a syringe.

The passage may include a stop for limiting insertion of the syringe barrel. When the barrel is maximally inserted the tip may extend through the valve. The stop can therefore be used to ensure that the tip has passed through the valve i.e. the user pushes the syringe into the closure as far as possible.

Aspects and embodiments of the present invention may provide one or more of the following features:

Auto cleaning of syringe
Auto closing of membrane
Clean inverted use when withdrawing the product
No risk of losing cap
Adjustment of hole diameter with tooling to adjust for different syringe sizes
Child resistant option The closure may be fitted with a valve, for example a self-closing valve formed from, for example, silicon or a thermoplastic elastomer.

The valve may be retained in a retaining device; the device (with the valve fitted) is insertable into the closure.

According to some embodiments there is provided a retaining device for retaining the self-closing valve in the closure, the device comprising a body for receiving a self-closing valve.

The body may have a crimping flange capable of being bent from an uncrimped position to a crimped position to retain the valve in the device, the body being receivable into a closure with the valve retained.

Where present, the crimping flange may comprise an upstanding wall.

The retaining device may comprise a circular upstanding wall and the crimping flange may comprise a circumferentially upstanding wall.

The device may comprise a bead for snap-fitting the device into a closure.

The device may comprise a sloping surface for receiving a valve flange.

The device may be formed as a retaining ring.

The device may be formed as a single-piece article.

The crimping flange may be adapted to engage a flange of a valve.

Devices or sub-assemblies may further comprise a sealing bead.

The device may be snap-fittable into the closure base.

The device and a closure base may include co-operating sealing beads for fixing the device into the closure.

The valve may be a non-laminar self-closing valve.

The device may be formed separately from a closure and also from a container.

The valve may comprise a flange, and the rigidity of the flange may be increased by the device.

The device may be retained within a closure by means of a mechanical and/or a chemical fit.

The valve may be retained in the device by being crimped in place.

The valve may be retained in the device by being glued in place.

The present invention also provides a retaining device as described herein, in combination with a non-laminar self-closing valve.

The present invention also provides, in combination, a retaining device or assembly as described herein with a self-closing valve fitted and positioned in a closure.

The closure base may comprise a wall for retaining the device in the closure, for example the sidewall of the dispensing passage.

The device may have an annular support surface and in which the flange is supported on the support surface such that after crimping the valve flange is trapped between the support surface and the crimping flange.

The crimping step may be performed without heating the crimping flange.

Valves according to the present invention may be formed from silicon or a silicon-based material.

The valve may be formed from a thermoplastic vulcanisate (TPV) material.

The valve may be formed from a thermoplastic elastomer (TPE) material.

The valve may be formed from a rubber material, such as nitryl rubber.

Combinations of different materials are possible. Bi-injected valves are possible.

A closure formed in accordance with the present invention may comprise a body connectable to a container, the body comprising a base and a lid, the lid being movable between a closed position and an open position, the closure having a locked position in which the lid is held in the closed position and an unlocked position in which the lid is released and can be moved to the open position, The body may include one or more pressing zones which are deflectable to move the closure to the unlocked position, The or each zone may be flanked by a pair of links, said links causing flexing forces to remain within the pressing zone during deflection.

At least one pressing zone may be provided on the lid.

At least one pressing zone may be provided on the base.

The links may be generally V-shape.

The links may form a continuous surface between the zone and adjacent regions of the body.

A child-resistant closure formed in accordance with the present invention may comprise a body connectable to a container, the body comprising a base having a body wall and a lid, the lid being releasably lockable in a closed position, the base further having one or more pressing zones forming part of the body wall for releasing the lid, the or each zone being connected to adjacent regions of the body wall by one or more insulating links, the link(s) blocking inward deflection of the zone(s) from spreading into said adjacent regions of the body wall.

A flip-top dispensing closure formed in accordance with the present invention may comprise a body including a base and a lid joined together by a hinge, the lid being movable between a closed position and an open position, the closure having a locked position in which the lid is held in the closed position and an unlocked position in which the lid is released and can be moved to the open position, the body having a body wall which includes one or more squeeze pads which are deflectable to move the closure to the unlocked position, the or each zone being connected to adjacent regions of the body wall by one or more deflection break links, the link(s) forming a continuous surface between the zone and the adjacent regions of the wall and cause flexing forces to remain within the squeeze pad during deflection.

A child-resistant closure formed in accordance with the present invention may comprise a base and a lid connected by a hinge, the base having an inner skirt and an outer skirt depending from a deck, their free ends terminating at approximately the same position, the closure further having locking means for releasably locking the lid in a closed position, the outer skirt having one or more pressing zones which can be pressed to release the locking means in a radially inward movement, characterised in that the inner skirt has one or more cut-outs in register with the or each pressing zone whereby to allow greater deflection thereof.

According to a first aspect of the present invention there is provided a child-resistant closure comprising a body with a sidewall and including locking means, the sidewall having one or more pressing pads for releasing the locking means, the or each pad being supported on the sidewall by force insulating links which restrict lateral spreading of forces into the sidewall during inward deflection of the pad.

The closure may comprise a body connectable to a container, the body having a body wall and having locking means for providing a child-resistant function, the body further having one or more pressing pads forming part of the body wall for releasing the locking means, the or each pad being connected to the body wall by one or more insulating links which block inward deflection of the pad from spreading into adjacent regions of the body wall.

The links isolate the pad from the sidewall so that when the pad is pressed the inward deflection is maximised because the deflection force does not spread into the sidewall. This provides for improved deflection of the pad.

The link serves as a deflection 'break' which isolates the pad from the sidewall on/in which it is provided.

By using links which connect the pad to the wall it is possible to form the wall in such a way that there are no dust traps or trapping risks created, with a continuous surface provided.

The pad-sidewall interface may be formed as an articulated linkage.

The pad-body interface may be formed as a floating hinge.

A 'batwing' configuration may be used for the or each link.

The links may flank the pad. Lateral and/or longitudinal flanking may be provided.

The body may have two pressing pads, although one, three or more pads are contemplated.

Diametrically opposed pads may be provided.

The or each link may be generally V-shape. The included angle of the V-shape may be in the range of 10° to 170°, such as 45° to 150°. For example, the included angle of the V-shape may be approximately 130°.

The link may comprise a plurality of corrugations.

The link may be at least partly curved. In some embodiments the link may be generally sinuous.

The link may comprise a material thickening. Differential thickening and/or different materials may be used to isolate the pressing force.

The body may be generally cylindrical. Other shapes such as oval, conical or square forms may be used.

The closure may be formed from a plastics material, for example by a moulding process such as injection moulding.

The body may comprise a base and a lid and the locking means may lock the lid in a closed position.

The base may comprise a recess defining an exposed peak on the lid.

The pad may be provided at or in the region of an end of the sidewall. Alternatively or additionally a pad may be provided within the sidewall.

The pad may be provided as part of a larger panel with the link/s operable to prevent spreading into the surrounding panel.

The closure may comprise a base and a lid, the base having an inner skirt and an outer skirt, the closure having locking means for releasably locking the lid in a closed position, the outer skirt having one or more pressing pads which can be pressed to release the locking means, in which the inner skirt has one or more cut-outs in register with the or each pressing pad whereby to allow greater deflection thereof.

By providing cut-outs in the inner skirt the outer skirt can be deflected further inwards to disengage the locking means. A reduction in materials can result, both from the removal of material to make the cut-outs and material savings which can be made due to the increased wall deflection.

The locking means may comprise a locking lug movable to an unlocked position by the pressing zone. Typically the lug would be biased to a locking position to allow re-set.

The lid may have one or more slots for receiving the or each locking lug and in the locked position the lug/s may project through the slot/s.

The lid may be connected to the base by a hinge, such as a snap hinge. Alternatively the lid may be releasable from the base.

The pressing zone/s may comprise a pressing pad. In some embodiments the zone may comprise a recessed panel. The locking means may be carried on or by the zone.

The closure may comprise and inner skirt and an outer skirt.

The outer skirt may comprise two pressing zones with the inner skirt comprising two corresponding cut-outs. The zones may be diametrically opposed to each other.

The closure base may further comprise a finger recess for lifting the lid following release of the locking means. The finger recess may be positioned diametrically opposite an articulation member such as a hinge if present.

The inner skirt may comprise retention means for securing the closure to a container. The retention means comprise a locking bead, which may be segmented.

The cut-out may comprise a notch. The notch may extend over part or substantially the full height of the inner wall. Alternatively, the cut-out may comprise a window in the inner wall.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combinations other than those explicitly set out in the claims.

The present invention will now be more particularly described, with reference to the accompanying drawings, in which are shown:

FIG. 1: closure in the closed position

Figure 2:
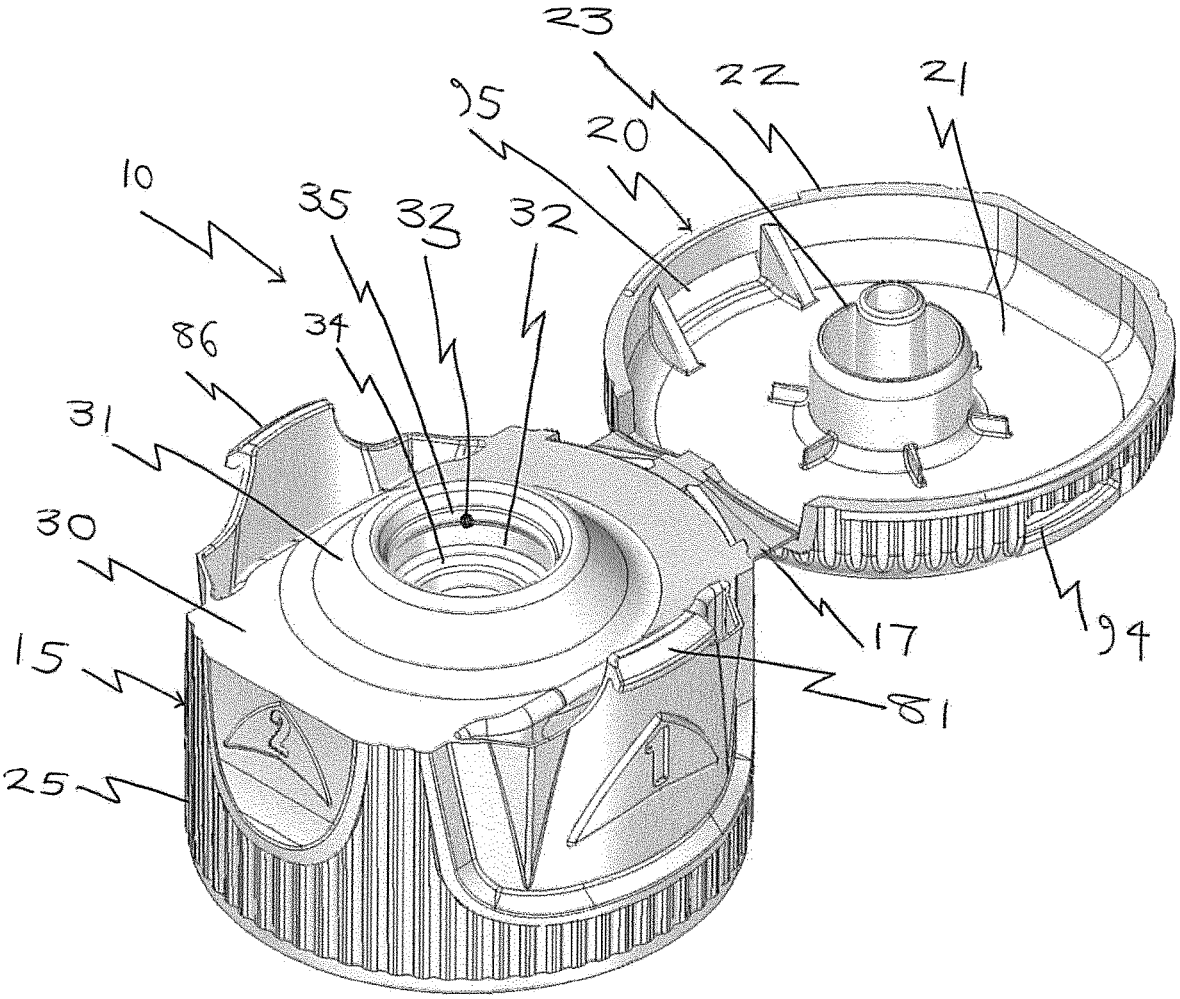

FIG. 2: closure in the open position

Figure 3:
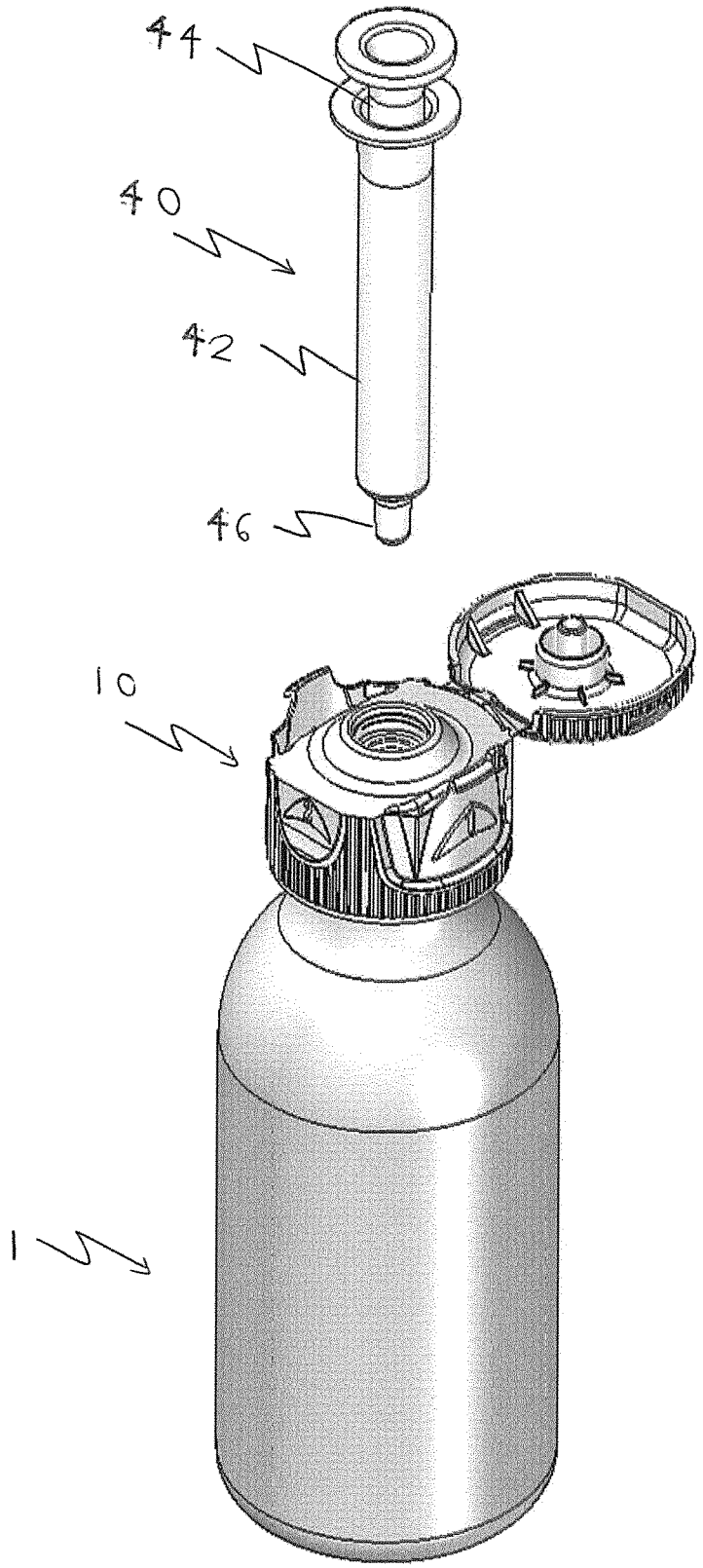

FIG. 3: syringe insertion

Figure 4:
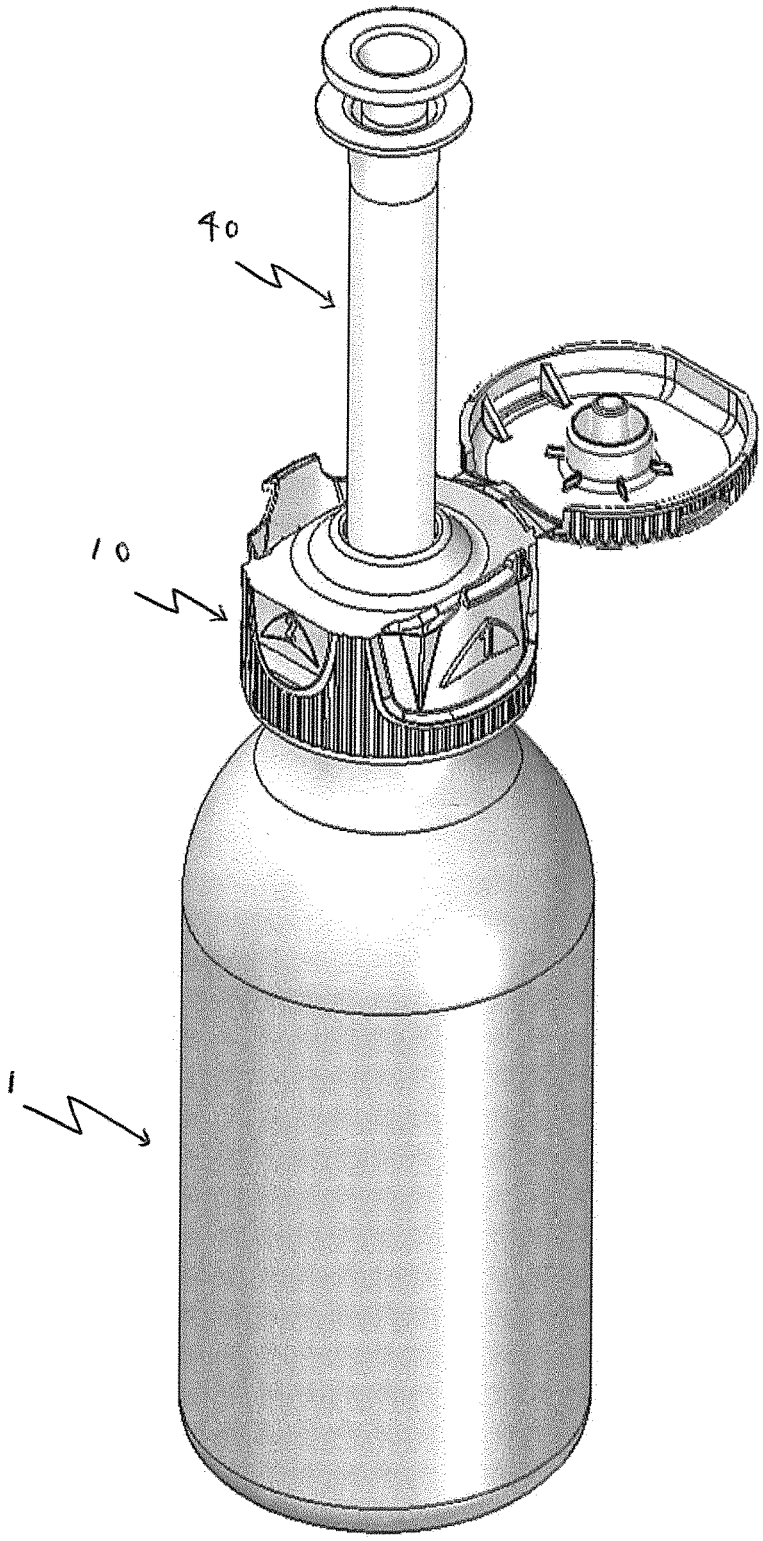

FIG. 4: syringe inserted

Figure 5:
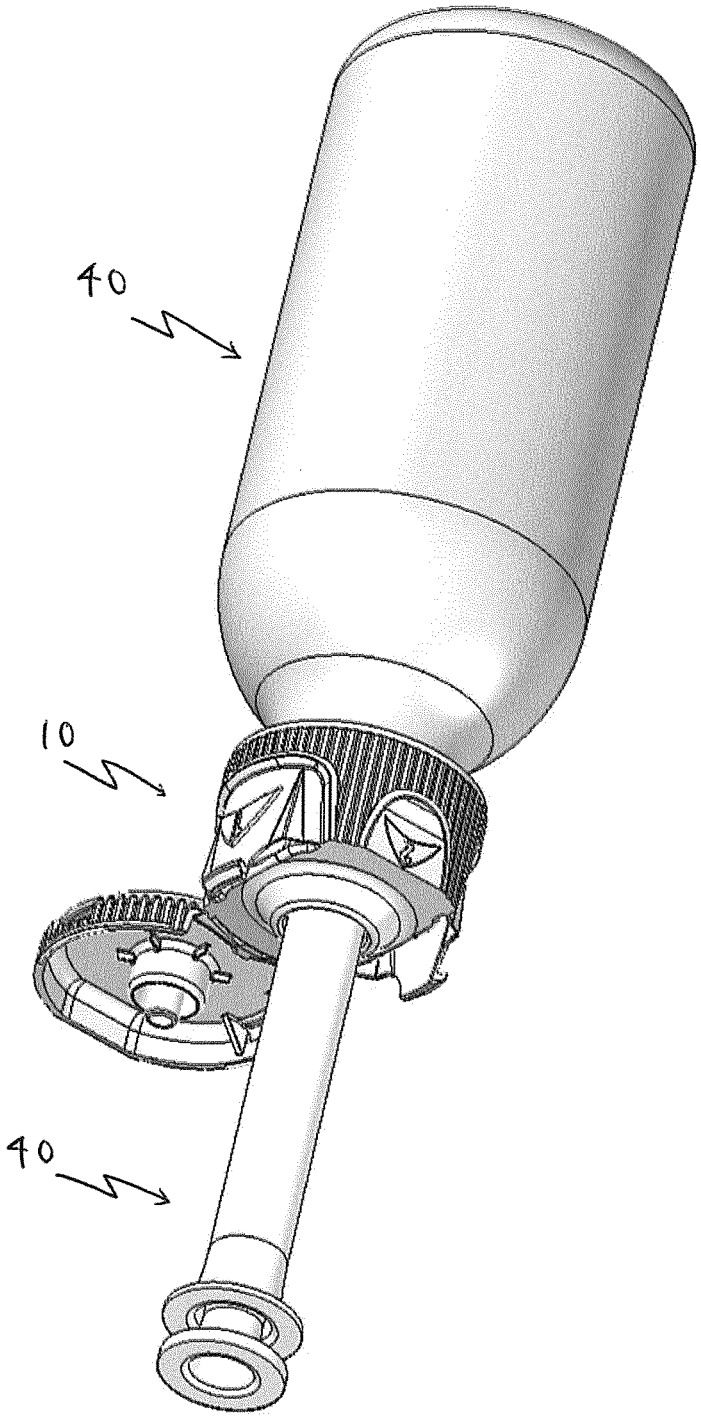

FIG. 5: bottle inversion

Figure 6:
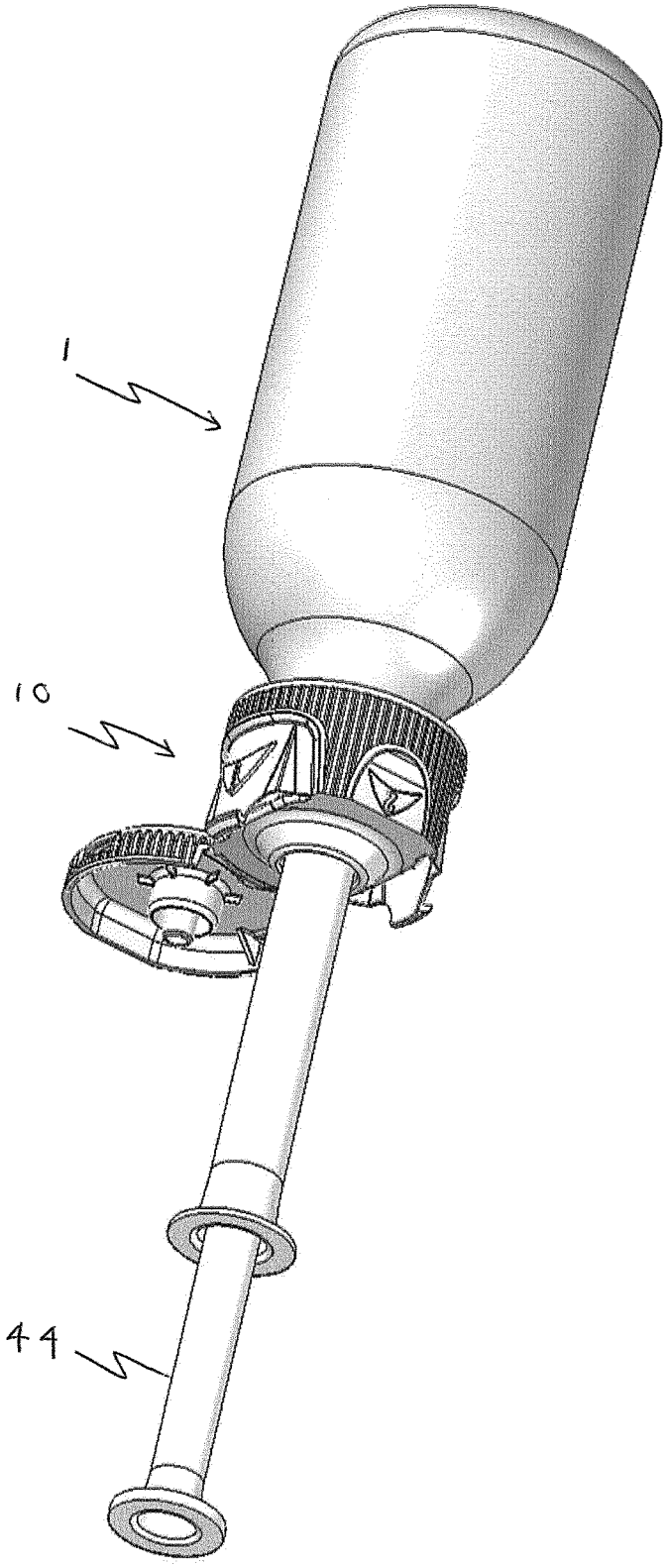

FIG. 6: plunger withdrawal

Figure 7:
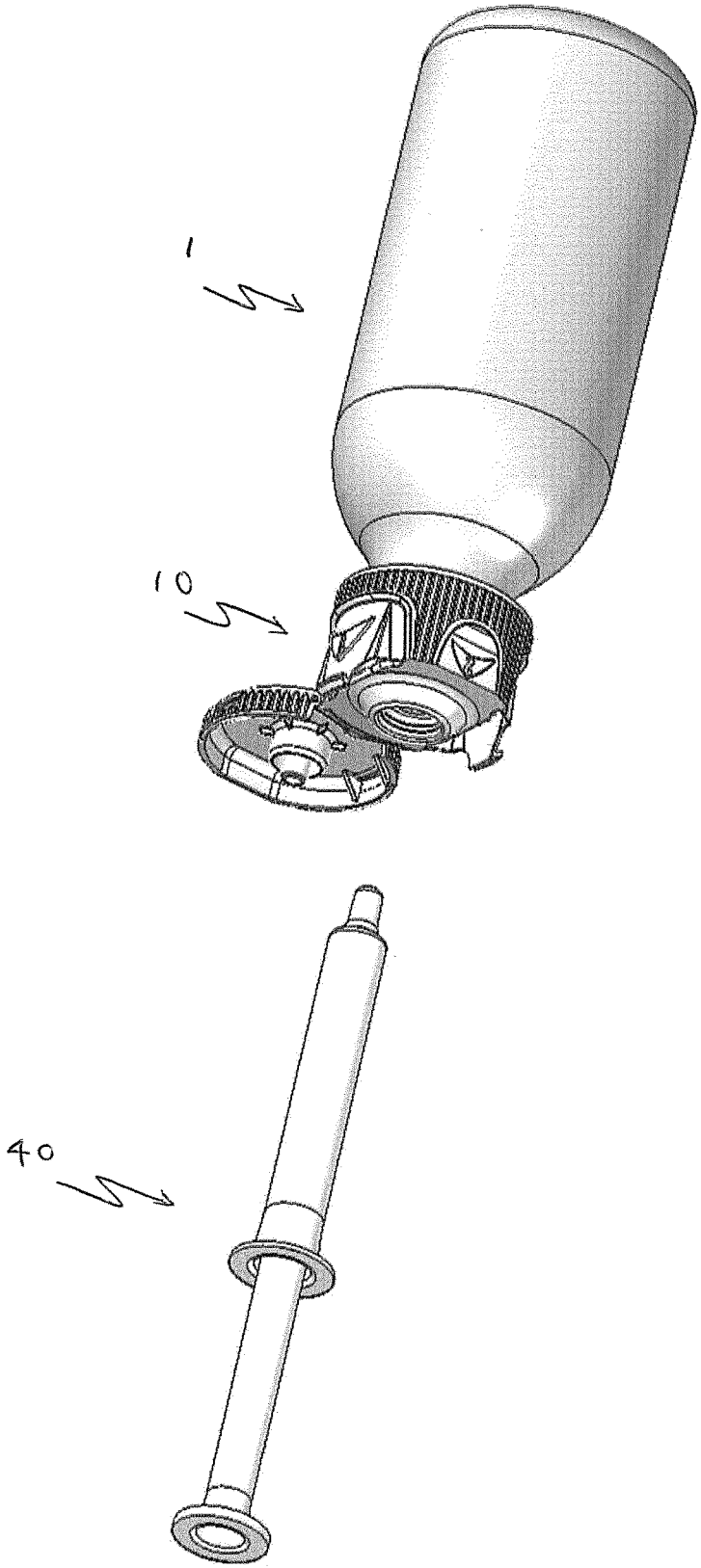

FIG. 7: syringe removal

Figure 8:
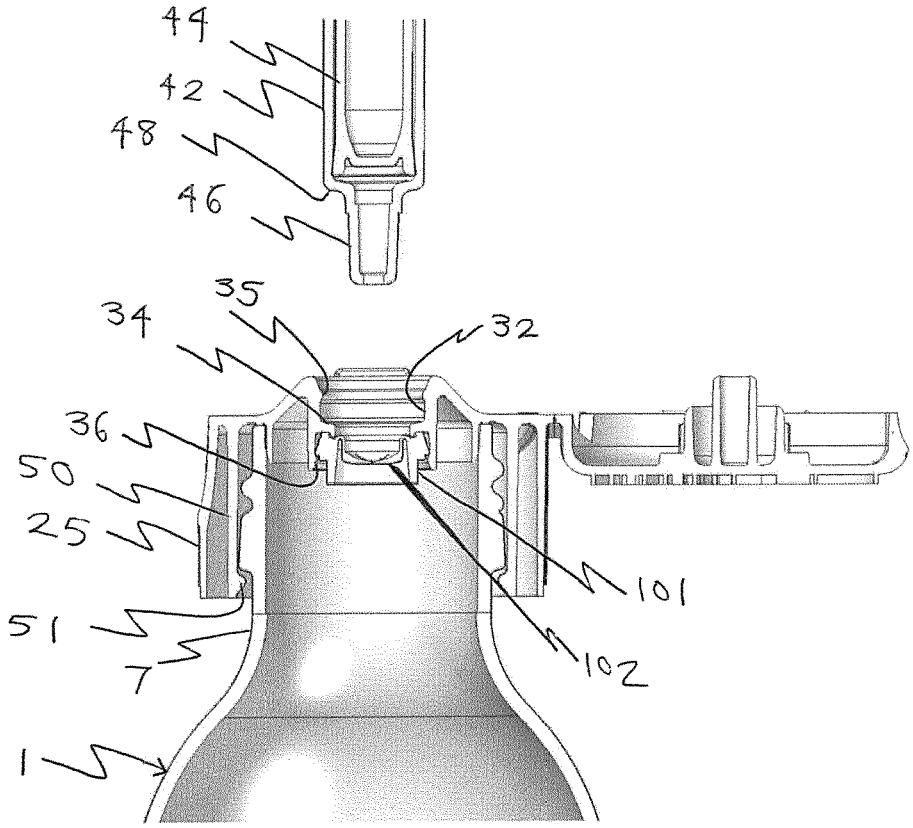

FIG. 8: section of the closure with the valve closed

Figure 9:
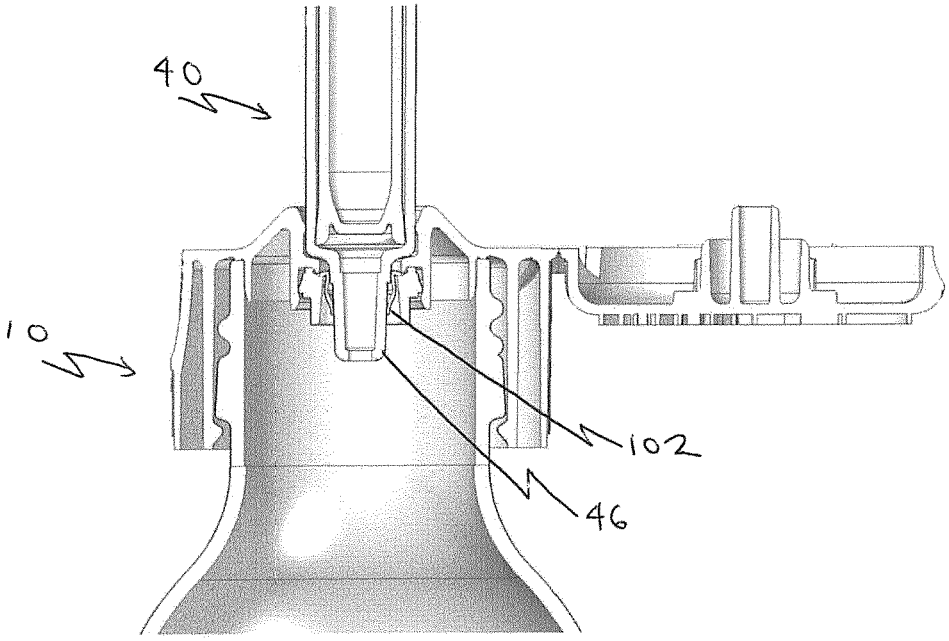

FIG. 9: section of the closure with the valve open

Figure 10:
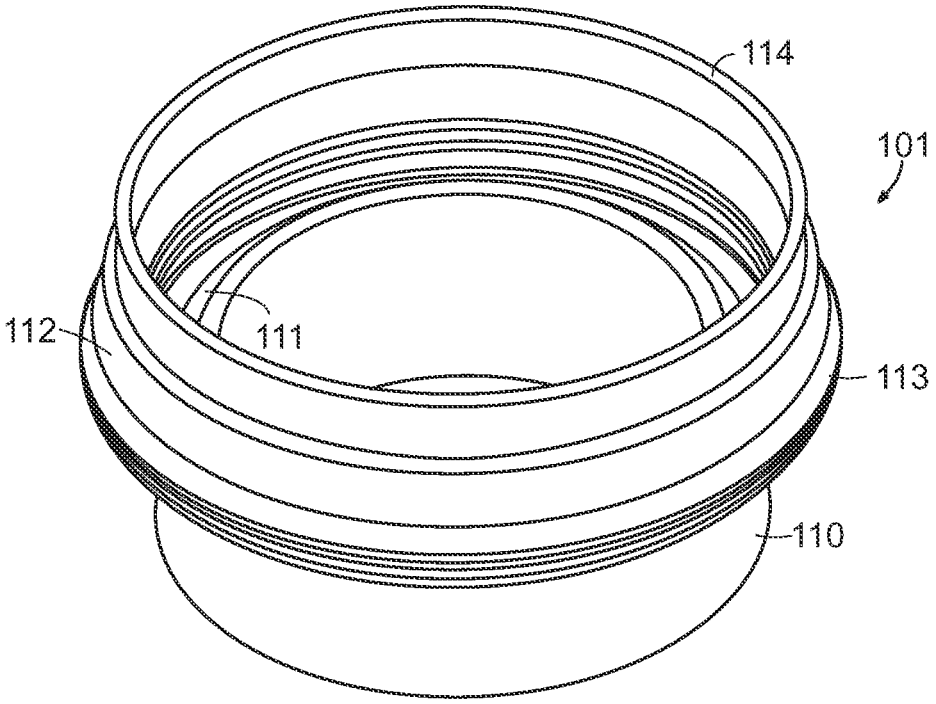

FIG. 10: a valve retaining device of the type fitted into the closure

Figure 11:
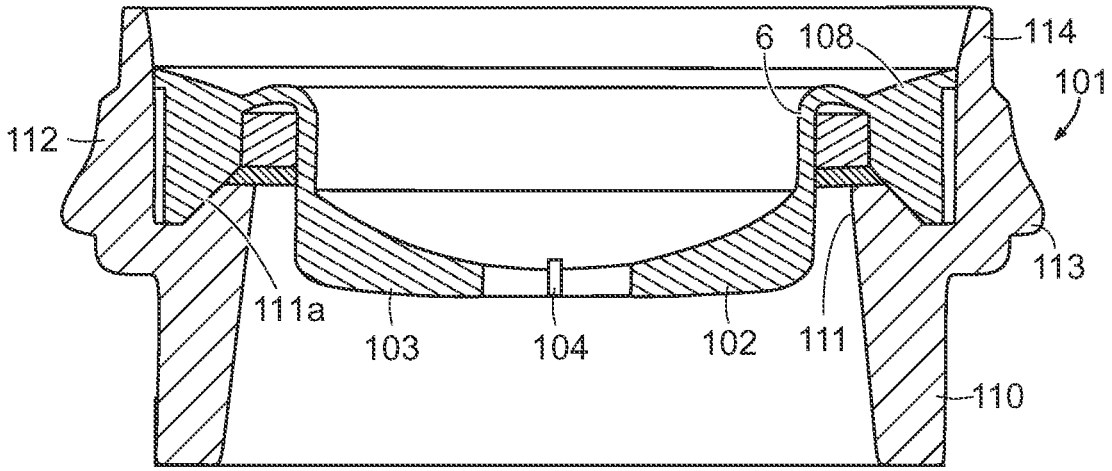

FIG. 11: section of the device of FIG. 10 and shown with a valve fitted

Figure 12:
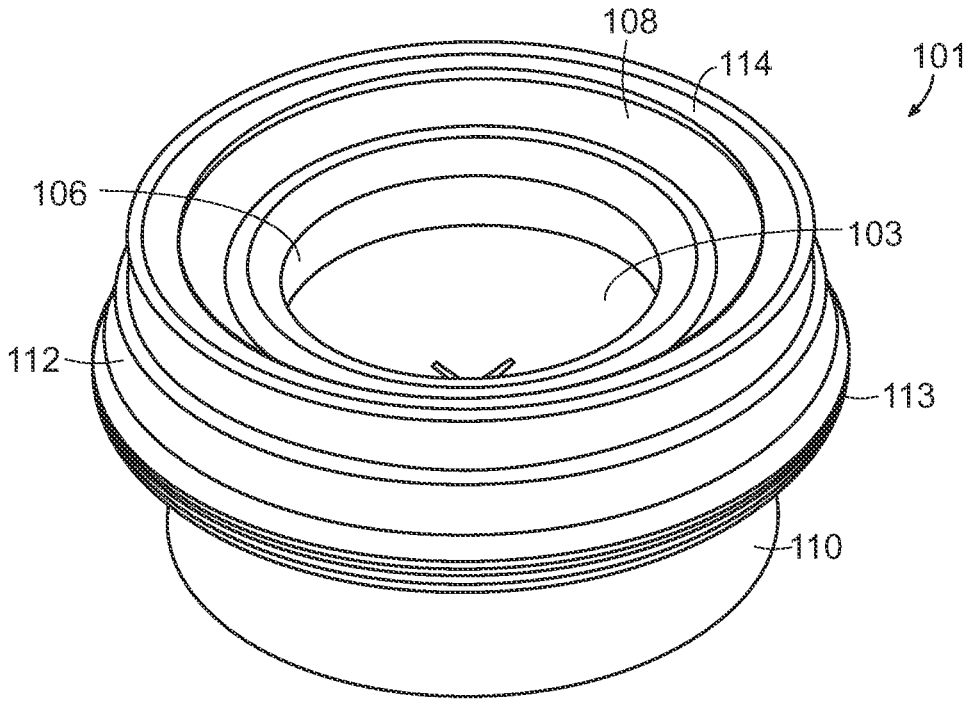

FIG. 12: view of the device of FIG. 10 with the valve secured in place

Figure 13:
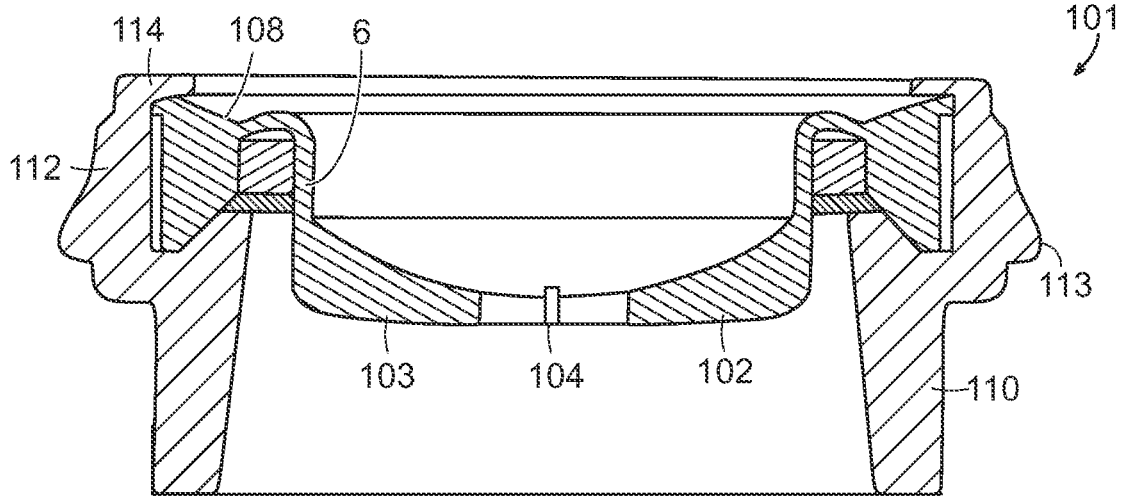

FIG. 13: section of the device of FIG. 12

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, top, bottom, radially and axially, are used in relation to the drawings and should not be interpreted as limiting on the invention.

Referring first to FIGS. 1 and 2, a closure is provided and is generally indicated 10. The closure 10 comprises a base 15 and a lid 20.

The base 15 comprises a generally cylindrical outer skirt 25. At the end of the skirt 25 which is adjacent to the lid a top deck 30 extends radially inwardly.

At the centre of the deck 30 is an upwardly inclined annular wall 31 which gives the deck an upwardly domed appearance. At the centre of the wall 31 a circular section cylindrical wall 32 depends and defines a dispensing passage 33.

The inner skirt 50 (see FIGS. 8 and 9) has two diametrically opposed windows (not shown).

The outer skirt 25 includes two diametrically opposed generally elongated U-shape recesses defined by panels 80, 85. The recesses are in register with the inner skirt windows as will be discussed in more detail below.

Each panel 80, 85 carries a lug 81, 86 at its free end which projects above the deck. Between each panel and the deck 30 is an arcuate slot 31.

Each lug 81, 86 comprises a chamfered upper surface 82, 87 and an undercut low surface 83, 88.

Each panel 80, 85 includes a respective central pad 90, 91. Each pad 90, 91 is flanked by a pair of links 93. Each link 93 comprises a pair of opposed, elongate right-angled triangular panels 93*a*, 93*b* arrange as a v-form, elbow-like hinge.

The inner skirt comprises a bead 51 at the free end which in use engages on a corresponding snap bead 5 on a container neck 7 as shown in FIGS. 8 and 9.

The base 15 and lid 20 are joined by a hinge 17, which in this embodiment is a snap hinge. Diametrically opposite the hinge a finger recess 27 is positioned in the outer skirt 25.

The lid 20 comprises a generally circular top plate 21 with a truncated side skirt 22 depending from its periphery except for the region where the hinge 17 is attached.

A centrally positioned annular spigot 23 depends from the top plate 21 and is dimensioned to be a tight fit in the passage 33 when the lid is in the closed position.

Two diametrically opposed slots 94, 95 are positioned in the lid 20 at the intersection of the skirt 22 and top plate 21. The slots are positioned so that when the lid is closed onto the base the lugs 81, 86 are engaged and firstly the chamfered portion 82, 87 of the lugs engages the free end of the skirt whereupon they are caused to deflect inwards until the lug passes into the slots whereupon they spring outwards to fill the slots. The lower surfaces 83, 88 of the lugs then engage onto the lower, ledge-like faces 96, 97 of the skirt sections which defines the slots 94, 95.

In use, the pads 90, 91 are depressed to move the lugs inwards. This releases the lugs from the lid slots. When the pads are deflected inwards they flex. The flexing is substantially constrained to be by the pads because the links 83 prevent lateral spreading of the forces into the adjacent panel sections. This maximised the inward deflection of the pads and hence the lugs.

The panels are resilient and the pads automatically spring back after release.

In this closed position shown in FIG. 1 the lid cannot be lifted because the slot base 91, 96 and lug surfaces 83, 88 are in abutment. In order to open the lid the recess panels must be pressed inwards to move the lugs out of the slots. Because the panels 80, 85 are in register with the inner skirt windows the panels can be deflected further radially inwards. At the same time the lugs are moved inwards the finger recess must be used to flip open the lid as is shown diagrammatically on the top of the lid in FIG. 2. The underside of the lid is provided with a trough 24 in register with the finger recess 27 in the closed position which serves as a leverage point to lift the lid.

As shown best in FIGS. 8 and 9, the passage 33 is formed like a socket, with the cylindrical sidewall 32 depending from the wall 31. At the mouth of the passage a bead 35 is provided. Below the bead 35 and spaced therefore an annular wall 34 extends radially inwards and functions as a stop. At the bottom of the wall 32 a further bead 36 is provided.

In this embodiment a 102 valve is fitted into the closure base. The valve is a flexible self-closing valve which in this embodiment is provided as part of a retaining device described in relation to FIGS. 10 to 13. The device 101, carrying the valve 102, clips into the base 15, fitting up into the sidewall 32 and clipping under the bead 36 so as to be firmly retained.

To use the closure 10 the lid 20 is first lifted, as described above. This exposes the passage 33. However, product cannot leave through the passage because of the valve 102.

A syringe 40 is presented to the closure 10 as shown in FIGS. 3 and 8. The syringe 50 comprises a cylindrical barrel 42 into which a plunger 44 is slidably and sealingly fitted. The barrel 42 terminates with a tip 46; a shoulder 48 is formed between the barrel and tip.

The syringe 40 can be pushed into the passage 33 until the shoulder 48 abuts against the stop 34. The additional height of the domed wall 31 helps to hold the syringe stably. In addition, the barrel is gripped by the bead 35.

As the syringe 40 is inserted the tip encounters the valve 102 and when maximally inserted is pushed through the valve as shown in FIGS. 5 and 9. With a slitted valve the tip pushes the petals apart.

Product can now be filled into the barrel by withdrawing the plunger with the bottle 1 inverted as shown in FIG. 6.

When the required dose is in the barrel the syringe is pulled out of the closure as shown in FIG. 7.

As the syringe is pulled out the tip passes back through the valve and because it is a flexible self-closing valve (with a resilient material which wants to return to the close position) the petals "wipe" the tip as it is withdrawn; the valve returns to its original, normally closed position when the tip is sully withdrawn. This means that the bottle 1 can remain upturned as the syringe is withdrawn as product will no longer pass through the valve 102.

Referring now to FIG. 10 there is shown a valve retaining device 101, which shall be referred to hereinafter as a retaining ring 101. The ring 101 consists of a moulded single-piece article with a so-called "chimney" in the form of a circular wall 110. This chimney 110 provides a surface for assembly machinery to handle the retaining ring 101. At one end of the chimney 110 is a radially outwardly sloping surface 111*a* provided on an annular wall 111. At the outer radial end of this sloping surface 111 another circular wall 112, which has the same rotational axis as chimney 10, and extends upwards.

Along the circumference of the radially outer surface of wall 112 is a projection in the form of an external sealing bead 113. At the end of wall 112 is a crimping flange 114 which in its uncrimped condition is an upstanding wall.

A flexible self-closing valve 102 typically has the features shown in FIG. 11. For instance, such a valve 102 has a head portion 103, which is thicker towards the edge than the centre and which has at least one slit 104 therein. The head portion is concave with respect to a container (not shown). This pre-stresses the valve so that it self-closes more easily.

A side-wall portion 106 connects the head portion 103 with a flange 108. Flange 108 is typically shaped such that it has a relatively substantial size in the form of a rim. It is this flange 108 which rests on the sloping surface 111 of the retaining ring 101 when it is located correctly.

In this embodiment, to crimp the valve 102 in place, the crimping flange 114 is bent over from the position shown in FIG. 11 until it sandwiches the flange 108 between itself 114 and the sloping surface 11 as shown in FIGS. 12 and 13.

Also shown is a valve 102 with the crimping flange 14 bent over. Although the crimping flange 108 is shown as being bent over by 90 degrees radially inwards it should be understood that the angle through which it need be bent is not fixed. For instance, it has been found that the crimping flange 114 need only be bent over by a few degrees in order that it hold the valve 2 in place within the retaining ring 101. This is because the crimping flange 114 is bent over along the entire circumference of the retaining ring 101 and valve 102. Further, the crimping flange 114 could be bent over by more than 90 degrees so that it lies against and substantially parallel with the surface of flange 108. described. It is important to understand that embodiments can be provided in many alternative forms and should not be construed as limited to the examples set forth herein.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A flip-top dispensing closure comprising:

a base which is attachable to a container and a lid attached to the base by a hinge, the base including a dispensing passage and a stop formed in the passage;

a syringe insertable into the passage, the syringe comprising a generally cylindrical barrel, a blunt-ended terminal tip, and a shoulder formed between the barrel and the blunt-ended terminal tip; and a flexible self-closing valve for closing the passage, the flexible self-closing valve comprising resilient petals with one or more slits extending between and defining the petals, wherein in use the syringe is inserted into the passage so that the blunt-ended terminal tip of the syringe pushes the petals apart from a normally closed condition to an open condition and passes through the slit of the valve to access product, and thereafter, when the syringe is withdrawn, the petals of the valve return to the normally closed position and wipe against the blunt-ended terminal tip, wherein the barrel can be inserted into the passage until the shoulder abuts against the stop, and wherein the passage includes an internal bead for gripping the syringe barrel in use.

2. A flip-top dispensing closure comprising:

a base which is attachable to a container and a lid attached to the base by a hinge, the base including a dispensing passage and an annular stop formed in the passage;

a syringe insertable into the passage, the syringe comprising a generally cylindrical barrel, a blunt-ended terminal tip, and a shoulder formed between the barrel and the blunt-ended terminal tip; and a flexible self-closing valve for closing the passage, the flexible self-closing valve comprising resilient petals with one or more slits extending between and defining the petals, wherein in use the syringe is inserted into the passage so that the blunt-ended terminal tip of the syringe pushes the petals apart from a normally closed condition to an open condition and passes through the slit of the valve to access product, and thereafter, when the syringe is withdrawn, the petals of the valve return to the normally closed position and wipe against the blunt-ended terminal tip, wherein the passage includes an internal bead and the valve is clipped into the passage by the bead, and wherein the barrel can be inserted into the passage until the shoulder abuts against the stop.

3. A closure as claimed in claim 1, in which when the barrel is maximally inserted the tip extends through the valve.

4. A flip-top dispensing closure comprising:

a base which is attachable to a container and a lid attached to the base by a hinge, the base includes a top deck, at the center of the deck is an upwardly inclined annular wall, at the center of the upwardly inclined wall a circular section cylindrical wall depends and defines a dispensing passage, the dispensing passage including a mouth, a bead provided at the mouth, and an annular stop wall that extends radially inwards below the bead and is spaced therefrom and functions as a stop;

a syringe insertable into the passage, the syringe comprising a generally cylindrical barrel, a blunt-ended terminal tip, and a shoulder formed between the barrel and the blunt-ended terminal tip; and a flexible self-closing valve for closing the passage, the flexible self-closing valve comprising resilient petals with one or more slits extending between and defining the petals, wherein in use the syringe is inserted into the passage so that the tip of the syringe pushes the petals apart from a normally closed condition to an open condition and passes through the slit of the valve to access product, and thereafter when the syringe is withdrawn, the petals of the valve return to the normally closed position and wipe against the blunt-ended terminal tip, and wherein the barrel can be inserted into the passage until the shoulder abuts against the stop.

5. A closure as claimed in claim 4, in which the flexible self-closing valve comprises a concave head portion which is thicker towards its edge than its centre and which has at least one slit therein.

6. A closure as claimed in claim 5, in which the valve includes a sidewall portion and a flange, the sidewall portion connects the head portion to the flange.

7. A closure as claimed in claim 5, further comprising a retaining ring, the valve is retained by the retaining ring.

8. A closure as claimed in claim 7, in which the retaining ring is received in the dispensing passage.

9. A closure as claimed in claim 8, in which the dispensing passage includes a further bead at a bottom of the cylindrical wall for retaining the retaining ring.

10. A closure as claimed in claim 9, in which the retaining ring is retained between the further bead and the annular stop wall.

11. A flip-top dispensing closure as claimed in claim 2, wherein an upper surface of the stop is inclined, and a lower surface of the shoulder is inclined.

12. A flip-top dispensing closure as claimed in claim 2, wherein the shoulder abuts and directly connects to the barrel.

13. A flip-top dispensing closure as claimed in claim 2, wherein the flexible self-closing valve is provided as part of a retaining device, and the retaining device, carrying the valve, is clipped into the base by the bead.

* * * * *